US005907945A

United States Patent [19]

Doyle

[11] Patent Number: 5,907,945

[45] Date of Patent: Jun. 1, 1999

[54] HOLIDAY LIGHT STORAGE AND STACKING APPARATUS AND METHOD

[76] Inventor: Donald E. Doyle, 4595 Baylor Ct., Saginaw, Mich. 48604

[21] Appl. No.: 09/090,494

[22] Filed: Jun. 4, 1998

[51] Int. Cl.[6] ..... B65D 85/42

[52] U.S. Cl. ..... 53/452; 206/419; 206/702

[58] Field of Search ..... 206/418–422, 206/495, 702; 53/452; 211/26; 362/249

[56] References Cited

U.S. PATENT DOCUMENTS

| | | | |
|---|---|---|---|
| 3,002,609 | 10/1961 | Batkin | 206/419 |
| 4,971,200 | 11/1990 | Huang et al. | 206/420 |
| 5,033,619 | 7/1991 | Garis | 206/419 |
| 5,123,534 | 6/1992 | Chwang | 206/419 |
| 5,168,999 | 12/1992 | Lee et al. | 206/420 |
| 5,317,491 | 5/1994 | Lee | 362/249 |
| 5,458,241 | 10/1995 | Brown | 206/419 |
| 5,513,081 | 4/1996 | Byers | 362/145 |
| 5,597,070 | 1/1997 | Wu | 206/419 |
| 5,641,075 | 6/1997 | Mechlin | 211/26 |
| 5,653,339 | 8/1997 | Dobson | 206/420 |

*Primary Examiner*—Jim Foster
*Attorney, Agent, or Firm*—John J. Swartz

[57] ABSTRACT

A holiday light set storage device and method for storing a holiday tree light set having a plurality of lights coupled together via wires. The holiday light storage device includes a base mounting a pair of upstanding, spaced apart light trays adjustably coupled to the base for movement relative to each other. At least one of the trays includes a plurality of laterally spaced apart, open-ended, upwardly opening slots for slidably receiving successive portions of the string in a zig-zag fashion. Adjacent lights on the string are disposed on the outer sides of the slots and the wires between adjacent bulbs are slidably received in the slots and extend between the inner sides of the upstanding trays. A cover is provided for enclosing the trays and the base.

27 Claims, 7 Drawing Sheets

HOLIDAY LIGHT STORAGE AND STACKING APPARATUS AND METHOD

BACKGROUND OF THE INVENTION

1. Field of the Invention

This invention relates to holiday light storage apparatus and method for storing a holiday light string and more particularly to a storage device which includes adjustable, slide storage trays for receiving storage strings which have light bulbs that are spaced at different intervals.

2. Description of the Prior Art and Objects

Holiday lights typically include a plurality of spaced apart light bulbs or lamps which are mounted in a lamp socket and are electrically coupled in circuit relation with a plurality of electrically conductive wires. Such light strings are typically distributed and sold, packaged in packaging systems or holders of the type described in U.S. Pat. No. 4,971,200 issued to Chen-Hsien Huang on Oct. 20, 1990; U.S. Pat. No. 5,123,534 issued to Wen T. Chwang on Jun. 23, 1992; U.S. Pat. No. 5,168,999 issued to Kuo-Hsing K. Lee on Dec. 8, 1992; U.S. Pat. No. 5,317,491 issued to Kuo-Hsing Lee on May 31, 1994; U.S. Pat. No. 5,458,824 issued to Peter A. Brown on Oct. 17, 1995; and U.S. Pat. No. 5,597,070 issued to Gordon K. H. Wu on Jan. 28, 1997.

The above mentioned prior art patented storage devices, although apparently acceptable for packaging newly manufactured bulbs, are inadequate for storing used light strings. The prior art storage devices such as that illustrated in the aforementioned U.S. Pat. No. 5,597,070 typically include a slit which must be spread apart in order to pass the base of the bulb which is brought to rest in an aperture communicating with the slot. The time consuming nature of this construction tends to detract from its use in storing light strings once removed from the receptacle.

More particularly, the prior art storage devices typically include a plurality of rows of light bulb holder bars including a plurality of adjacent slits communicating with apertures into which the bases of the light bulb sockets are disposed. These slits are typically very closely spaced and are not readily spreadable or accessible. Also, there are no provisions for adjusting the distances between the adjacent light to allow adequate storage for the spacing therebetween. Moreover, the prior art devices are not adjustable to accommodate light strings having lights spaced at different intervals. If the user merely deposits the strings into a box, they become entangled and are difficult to separate. The users will sometimes store the individual light sets in individual bags and dispose a plurality of bags in a storage box, or the like. When holiday light strings are stored in this fashion, the individual portions of the wires and lights of each string become intertwined thereby making it difficult to unwind them the following holiday season.

U.S. Pat. No. 5,653,339 issued to Alicia A. Dobson on Aug. 5, 1997 discloses a receptacle receiving a plurality of individual light support racks around which holiday lights are wrapped before being deposited into a storage container. This prior art device includes a plurality of individual parts which can easily separate and become lost. Also, this device does not have any features for adjusting to light strings having bulbs spaced at different intervals. Finally, this prior art device is rather bulky and does not compactly store the light strings in a stack. Accordingly, it is yet another object of the present invention to provide a universal light mounting apparatus which can be easily adjuster to accommodate light strings having bulbs spaced at different intervals.

It is another object of the present invention to provide a new and novel holiday light string storage device which will compactly store the string.

U.S. Pat. No. 5,641,075 issued to Robert M. Mechlin on Jun. 24, 1997 discloses a tubular storage rack having a plurality of slots therein which internally receive the light bulbs and the electrical conductor portions of the lights therebetween are disposed on the outside of the tubular rack. A user will sometimes test the bulbs inside a warm building while still on a rack rather than outside in the cold by plugging the power cord into an electrical receptacle. The user's ability to easily scan the string is inhibited with the Mechlin device because the bulbs are somewhat hidden. Moreover, if a bulb has to be replaced, it is not readily accessible without removal of the string from the rack. This latter mentioned prior art structure likewisely does not include apparatus which is adjustable to properly store light strings having lights which are spaced at various intervals and for storing the lights on the insides of the rack rather than the outsides of slotted storage rack. Accordingly, it is an object of the present invention to provide new and novel holiday light set storage apparatus and method for storing a holiday light string.

It is another object of the present invention to provide holiday light set storage apparatus including a pair of spaced apart storage racks on which successive portions of the light strings can be alternately wrapped.

It is a further object of the present invention to provide holiday light storage apparatus of the type described including storage trays which are adjustably mounted for movement relative to each other to accommodate light sets which have different distances between the adjacent light bulbs.

A still further object of the present invention is to provide holiday light storage apparatus of the type described which will mount the bulbs outwardly in stacked relation for easy inspection and replacement.

Another object of the present invention is to provide holiday light storage apparatus of the type described including a slotted storage tray which slidably receives the holiday light bulbs on the outside of the tray with the electrical conductors portions coupling adjacent light bulbs being received in the slots.

Yet another object of the present invention is to provide a light storage apparatus of the type described wherein the electrical conductors coupling adjacent light bulbs are disposed between the insides of elongate slotted racks and the light bulbs are disposed on the outer sides of the elongate racks.

Another object of the present invention is to provide a light string storage apparatus of the type described which includes a storage member having a plurality of easily accessible upwardly opening slots into which the lights can be easily deposited and removed.

It is a further object of the present invention to provide a new and novel method for storing light strings having light bulbs which are spaced apart at differing distances.

Another object of the present invention is to provide a new and novel method for storing a holiday light string wherein the lights are stored on the outer sides of spaced apart elongate racks and the electrical conductor portions between adjacent lights bulbs are received in the slots and extend between the inner sides of the racks.

It is a still further object of the present invention to provide a new and novel method and apparatus for storing holiday light strings wherein a light string is mounted on adjacent, spaced apart elongated storage racks in a zig-zag fashion with successive adjacent portions of the light string being disposed on the outer sides of the elongate racks and the portions between the adjacent successive portions being disposed between the confronting inner sides of the racks.

It is yet another object of the present invention to provide method and apparatus for storing and stacking a string of lights having a plurality of light bulbs coupled in circuit relation with electrical connections including sequentially mounting successive adjacent light bulbs in a zig-zag path alternately on the outer sides of the stacking members with the portion of the electrical connections between the successive adjacent light bulbs passing through the slots and thence extending between the confronting inner sides of the stacking members.

Other objects and advantages of the present invention will become apparent to those of ordinary skill in the art as the description thereof proceeds.

SUMMARY OF THE INVENTION

Holiday light storage apparatus and method for storing a string of holiday light bulbs coupled in circuit with electrical conductors comprising: a base, a pair of elongate light storage racks for alternately receiving successive portions of the string on the outer sides of the racks and the conductors between the successive portions being disposed between the inner sides of the racks, and mechanism for adjustably mounting the racks on the base for movement relative to each other.

DESCRIPTION OF THE DRAWINGS

The invention may be more readily understood by referring to the accompanying drawings, in which.

DESCRIPTION OF PREFERRED EMBODIMENT

Figure 1:
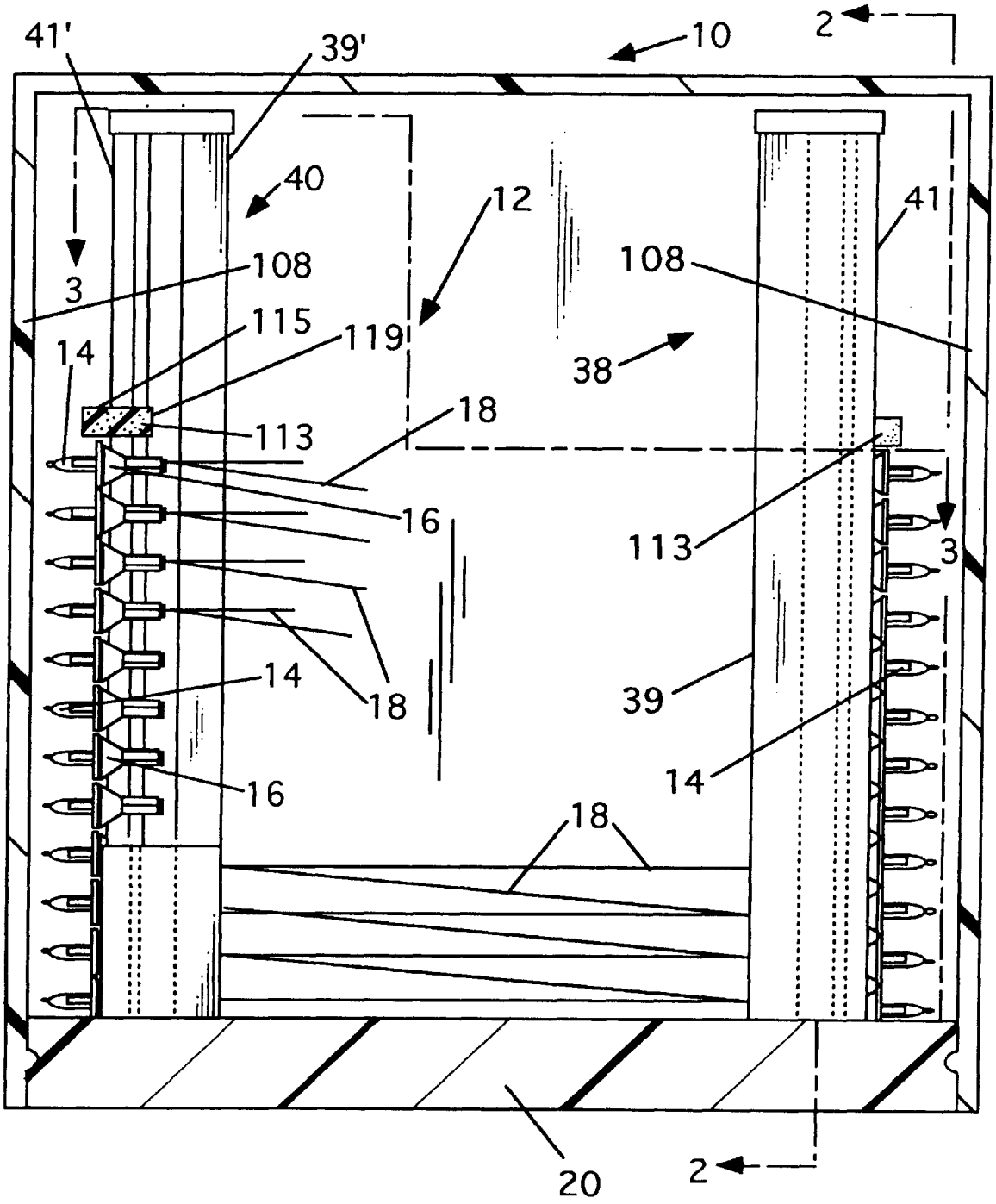
FIG. 1 is a sectional side view holiday light storage apparatus constructed according to the present invention, taken along the section line 1—1 of FIG. 2; parts of one of the light bulb mounting racks being broken away, partly in section, to more clearly illustrate the bulbs and stop mounted therein.

Holiday light storage and stacking apparatus, generally designated 10, constructed according to the present invention, is particularly adapted for storing one or more holiday light strings, generally designated 12 and including a plurality of light bulbs 14 electrically coupled in circuit relation via light sockets or bases 16 which threadedly or frictionally, slidingly receive the bulbs 14. The light strings 12 also include wires or electrical conductors 18 which couple the bulb sockets 16 and bulbs 14 to a source of electrical power (not shown).

The apparatus 10 includes a flat elongate base or platform, generally designated 20, having a centrally disposed, elongate, mounting slot or passage 22 extending between the top and bottom surfaces 24 and 26, respectively, thereof. A pair of laterally spaced apart, elongate slots 28 are cut or otherwise formed in the top base surface 24. The base 20 also includes front and rear surfaces 30 and 32 having elongate slots 34 and 36 provided therein for receiving a cover 33, as will be described more particularly hereinafter.

Adjustably mounted on the base 20, which may suitably be formed of plastic material, is a pair of one-piece, spaced apart, upstanding, elongate light string stacking and mounting racks 38 and 40 which are identical but when mounted on the base 20, are turned 180° relative to each other. Each light string mounting rack 38 and 40 comprises an upstanding tray, generally designated 42, having a lower base end 44 provided on its underside with a pair of longitudinally extending integral, dependent tracks 46 which are received in the elongate slots 28 provided in the top of the base 20 for guiding and sliding movement therein. The trays 42 may also suitably be formed from extruded plastic.

A screw fastener 48 or the like is received in the base slot 22 and is detachably threadedly received at 50 in the base 44.

The rack 38 includes longitudinally inner and outer sides 39 and 41, respectively. The upper portion 52 of the rack 38 includes a plurality of upwardly opening, open-ended, parallel slots, generally designated 54, for receiving the light sockets 16. The slots 54 are defined by a pair of outer posts, generally designated 56 and 58 and three intermediate posts, generally designated 60, 61 and 62. The slots 54 are more particularly identified individually as two laterally outer slots 53 and 59 between the posts 56 and 58 and the laterally adjacent posts 60 and 62, respectively, and two intermediate slots 55 and 57 between the three intermediate posts 60, 61 and 62.

The two laterally outer posts 56 and 58 each include a longitudinally outer side wall 64 integrally mounting inner and outer laterally spaced apart upstanding walls generally designated 66 and 68, respectively.

Each inner wall 66 is V-shaped and includes longitudinally disposed, laterally inwardly converging inner and outer wall portions 72 and 74 converging to an apex 76.

The three center posts 60, 61 and 62 each include a pair of substantially identical, oppositely disposed, V-shaped side walls 78 and 80 having longitudinally inner and outer integral wall portions 82 and 84 which laterally converge to an apex 86. The longitudinally outer ends 88 of the walls 78 and 80 are spanned by an outer upstanding wall 90. Each of the three center posts 60, 61 and 62 includes an integral, vertical reinforcing strip 91 extending inwardly from the outer upstanding wall 90.

The adjacent, confronting apexes 76 and 86 of adjacent posts 56, 58, 60–62 are disposed in confronting relation to form a plurality of nips 92 which receive the light bulb bases 20 for vertical sliding movement therein.

The upper terminal tray ends 94 and 95 of posts 56, 58 and the three inner posts 60, 61 and 62, respectively, are covered by caps 96 and 98, respectively, which have shapes corresponding to the shapes of posts 56, 58 and 60, 61 and 62, respectively.

The rack 40 is identical to the rack 38 and generally similar parts are identified by generally similar reference characters followed by a prime designation subscript.

Figure 2:
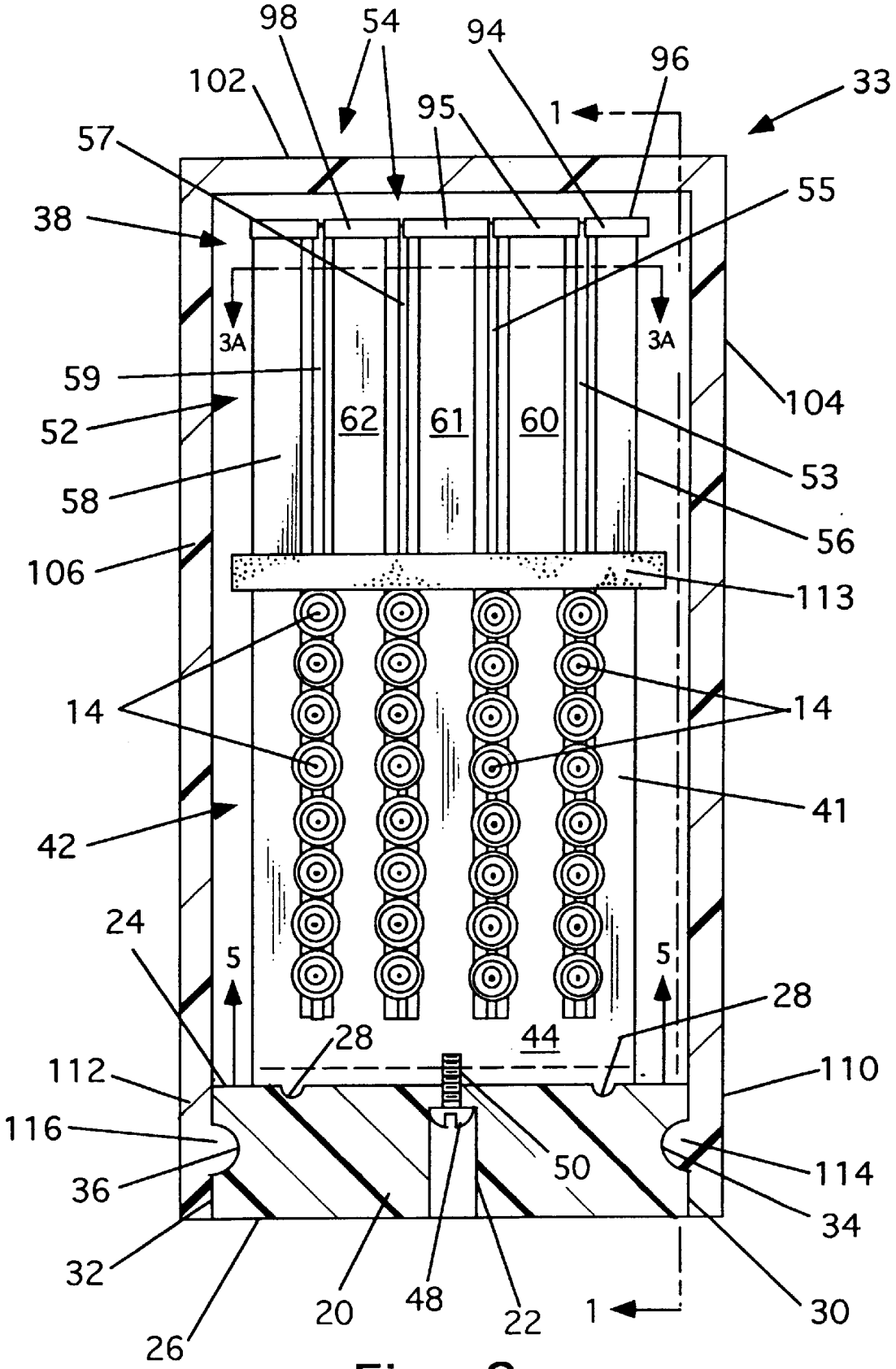
FIG. 2 is a sectional end view taken along the section line 2—2 of FIG. 1.

The cover, generally designated 33, is provided for protecting and enclosing the light string storage members 38 and 40 and the lights disposed thereon and includes a top wall 102 dependently integrally mounting front and rear walls 104 and 106 and end walls 108 spanning the walls 104, 106. The inside lower ends 110 and 112 of the front and rear walls 104 and 106 include longitudinally extending tracks 114 and 116, respectively, which are detachably received in the front and slots 34 and 36, respectively, provided in the base 20. The cover 33 is manufactured from yieldable plastic or the like which allows the lower ends 110 and 112 to slightly distort as the cover 33 is moved downwardly to the position illustrated in FIG. 2.

A detachable stopper, generally designated 113, is provided for detachable insertion into the slots 54 after the stacking is completed to secure the stack. The stopper 113 may suitably comprise rubber or other resilient material having a base 115 mounting a plurality of projections 119 which have a shape generally complemental to the shape of the slots 54, but are slightly larger than the slots 54, so as to be snugly, resiliently detachably receiving therein to detachably hold the stopper 113 and underlying stacked light strings 12 in place.

The Operation

The user will remove the cover 100 from the base 20 to expose the upstanding light string mounting members 38 and 40. The screw fasteners 48 will be unturned from one or both of the racks or plate mounting members 38 and 40 to allow each of the racks 38 and 40 to be moved relative to each other to the desired spacing so that the spacing between adjacent bulbs 14 is such that there will be no substantial slack in the conductors 18 disposed between the inner sides 39, 39' of the racks 38 and 40, respectively.

Figure 3:
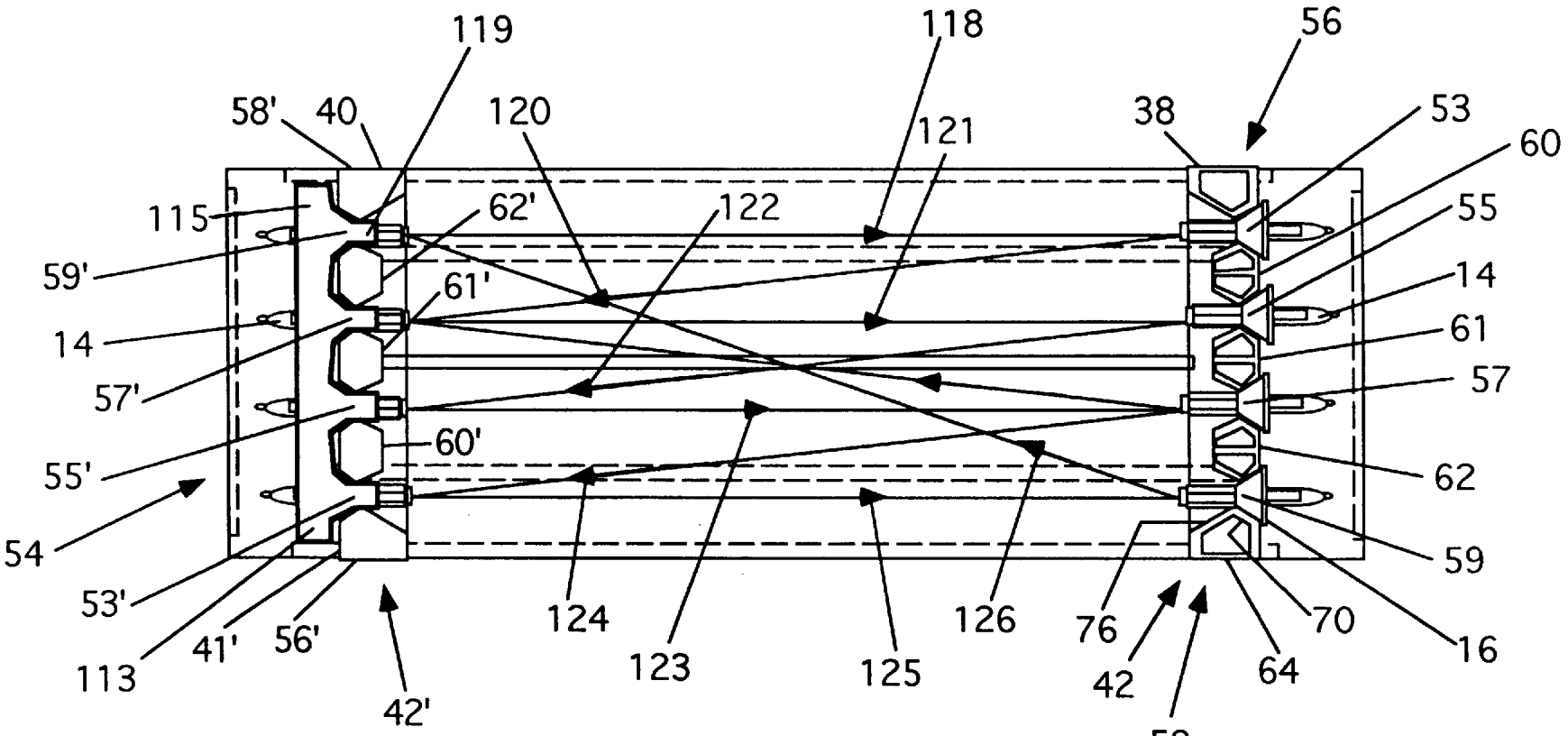
FIG. 3 is a top plan view, partially in section, taken along the line 3—3 of FIG. 1.
Figure 3A:
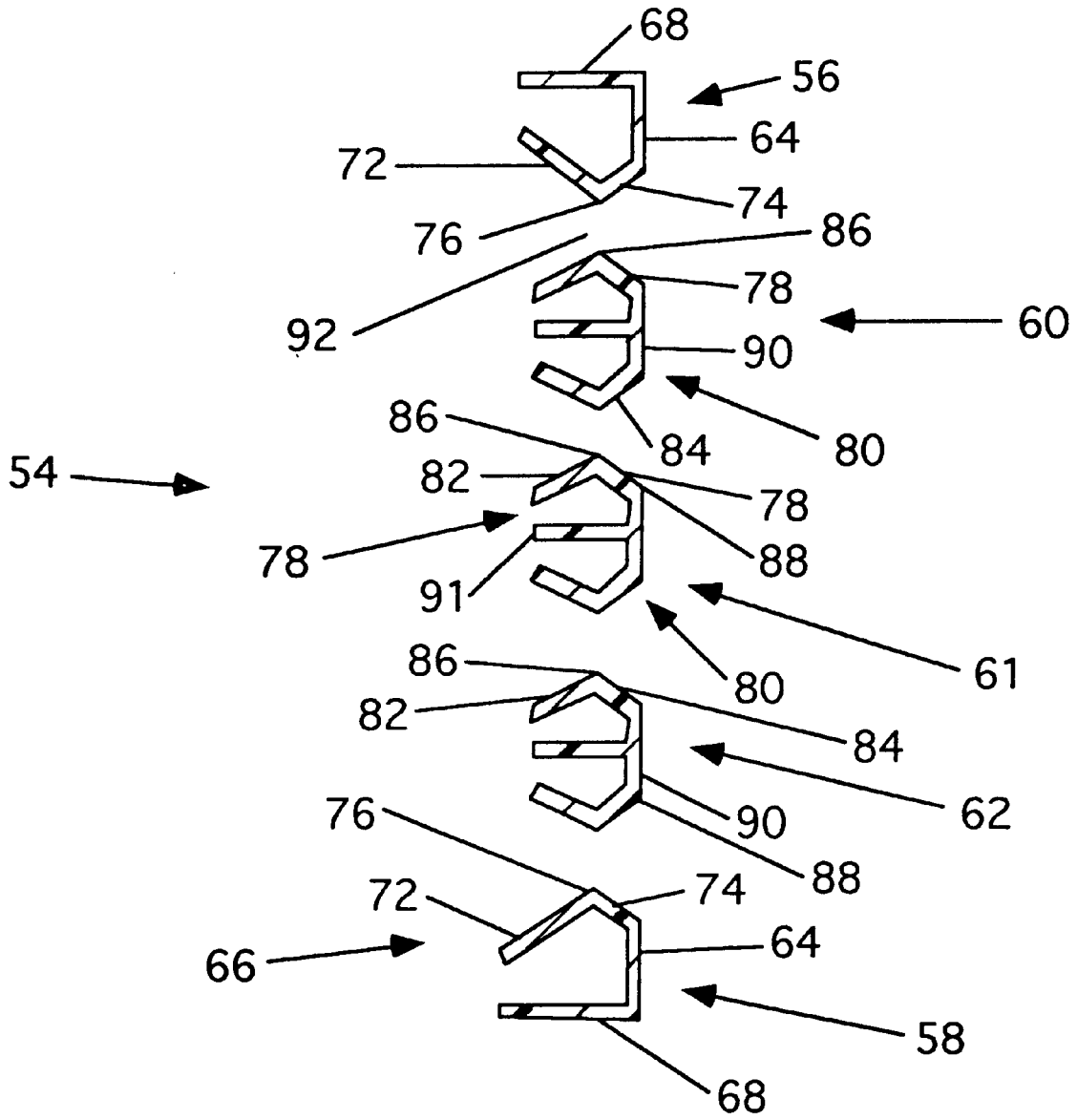
FIG. 3A is a greatly enlarged sectional top plan view taken along the section line 3A—3A of FIG. 2, illustrating in more detail the construction of one of the light receiving trays.
Figure 4:
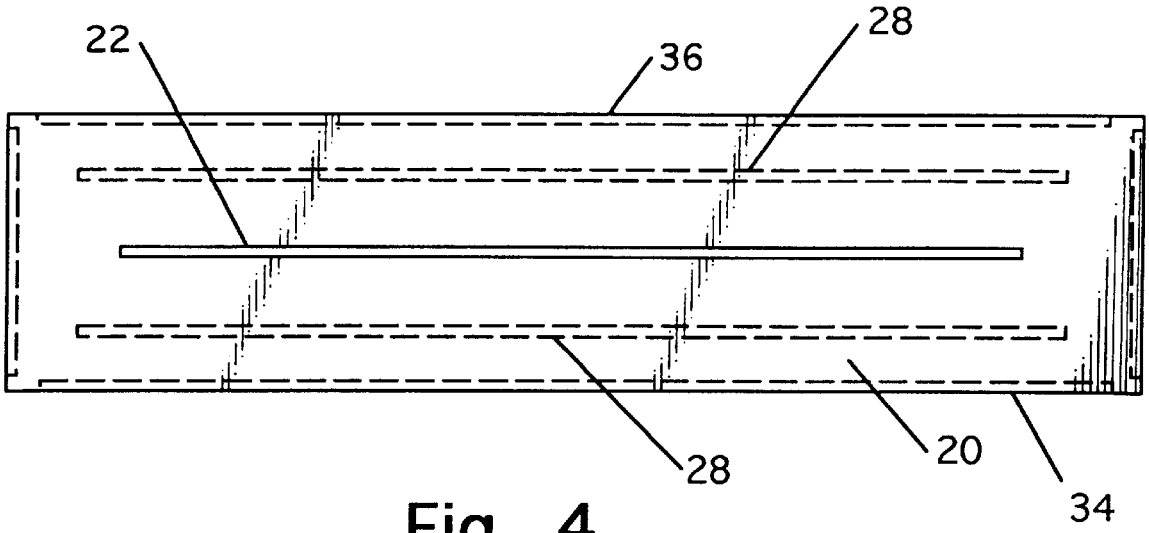
FIG. 4 is a slightly reduced top plan view of the base only.
Figure 5:
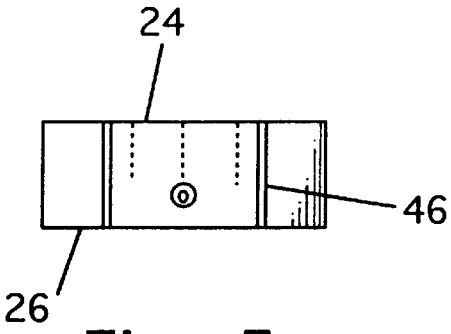
FIG. 5 is a slightly reduced bottom plan view of one of the stacking trays, take along the line 5—5 of FIG. 2.
Figure 6:
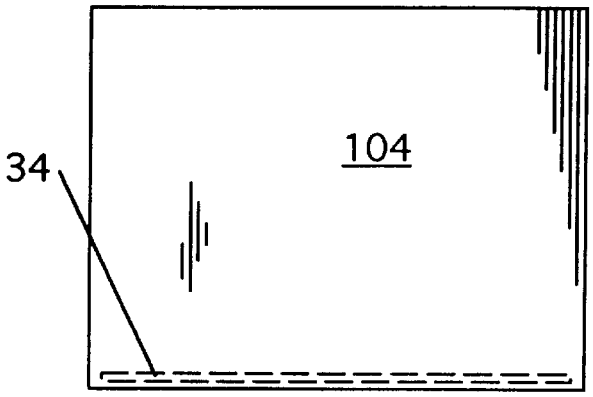
FIG. 6 is a reduced front side elevational view of a cover for the light storage apparatus.

The user will initially dispose an endmost one of the light bulb bases 16 in one of the slots 59', for example, in the rack 40 with the light bulb 14 of the outer side 41' facing outwardly. The next successive adjacent light bulb socket 16 will be disposed in the end most slot 53 of the rack 38 with the bulb 14 therein extending outwardly of the outer side 41. The portion of the wire represented by the arrow 118 (FIG. 3) therebetween will be tautly disposed between the inner sides 39 and 39' of the light string mounting members 38 and 40. The third or next adjacent light bulb 16 will be disposed in the slot 57' and the next successive portion of the wire between the second and third bulbs 14, represented by the arrow 120, will be disposed between the inner sides 39, 39' of the racks 38, 40, respectively, and the third bulb 14 will again be disposed outwardly of the outer side 41'.

The bulb sockets 16 and bulbs 14 will continue to be disposed alternately in one of the slots 55, 55', 57, 53' and 59 of the light string mounting members 38 and 40 in a series fashion such as represented by the arrows 121–125, respectively. At this time, one layer will have been completed. The user then threads the next bulb in the initial slot 59' (as represented by the arrow 126) and repeats the pattern described heretofore to form successive layers.

The successive adjacent lines 121–126 and bulb sockets 16 and bulbs 14 coupled to the junctions thereof are successively mounted on the members 38 and 40 in a similar zig-zag fashion so that successive adjacent light bulbs 14 are alternately disposed in the racks 38 and 40 to neatly stack the string in layers. Additional strings can be added until the slots 54 are sufficiently filled.

After the completion of the installation of all of the light strings, a stop, generally designated 113, can be disposed between the posts 56, 58 and 61–62 on the top of the stack to hold the stack in place and prevent it from being dislodged inadvertently.

Alternate Embodiment

Figure 7:
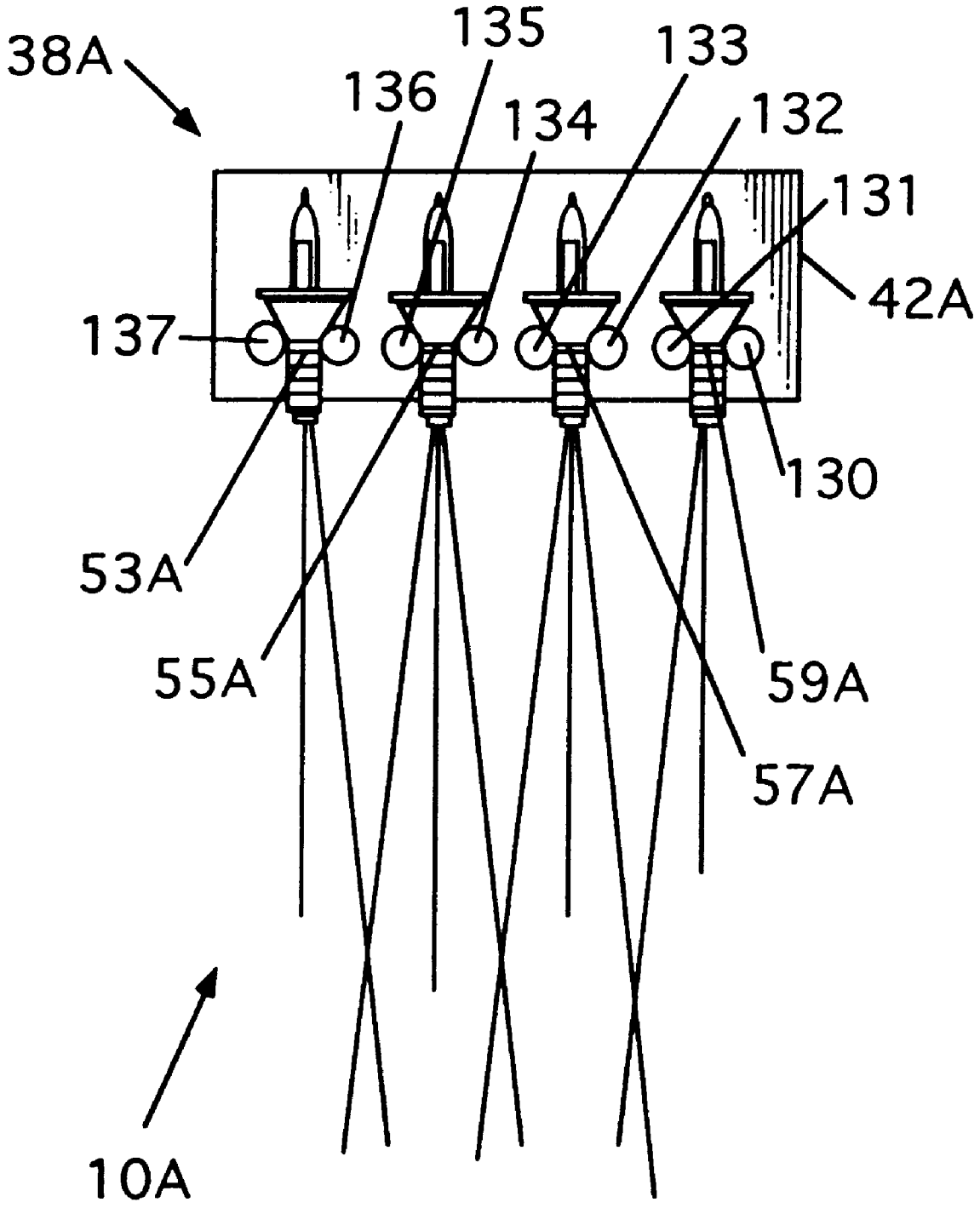
FIG. 7 is a top plan view of a slightly modified embodiment.

A slightly modified storage apparatus, generally designated 10A, is illustrated in FIG. 7 and generally similarly parts will be identified by generally similar reference characters following by the letter A subscript. Rather than the rack 38, the apparatus includes a light mounting rack generally designated 38A.

The light mounting rack 38A includes a plurality of upstanding posts or dowel rods 130–137 which replace the posts 56, 58, 60, 61 and 62, to form laterally adjacent, upwardly opening slots 53A, 55A, 57A and 59A.

Second Alternate Embodiment

Figure 8:
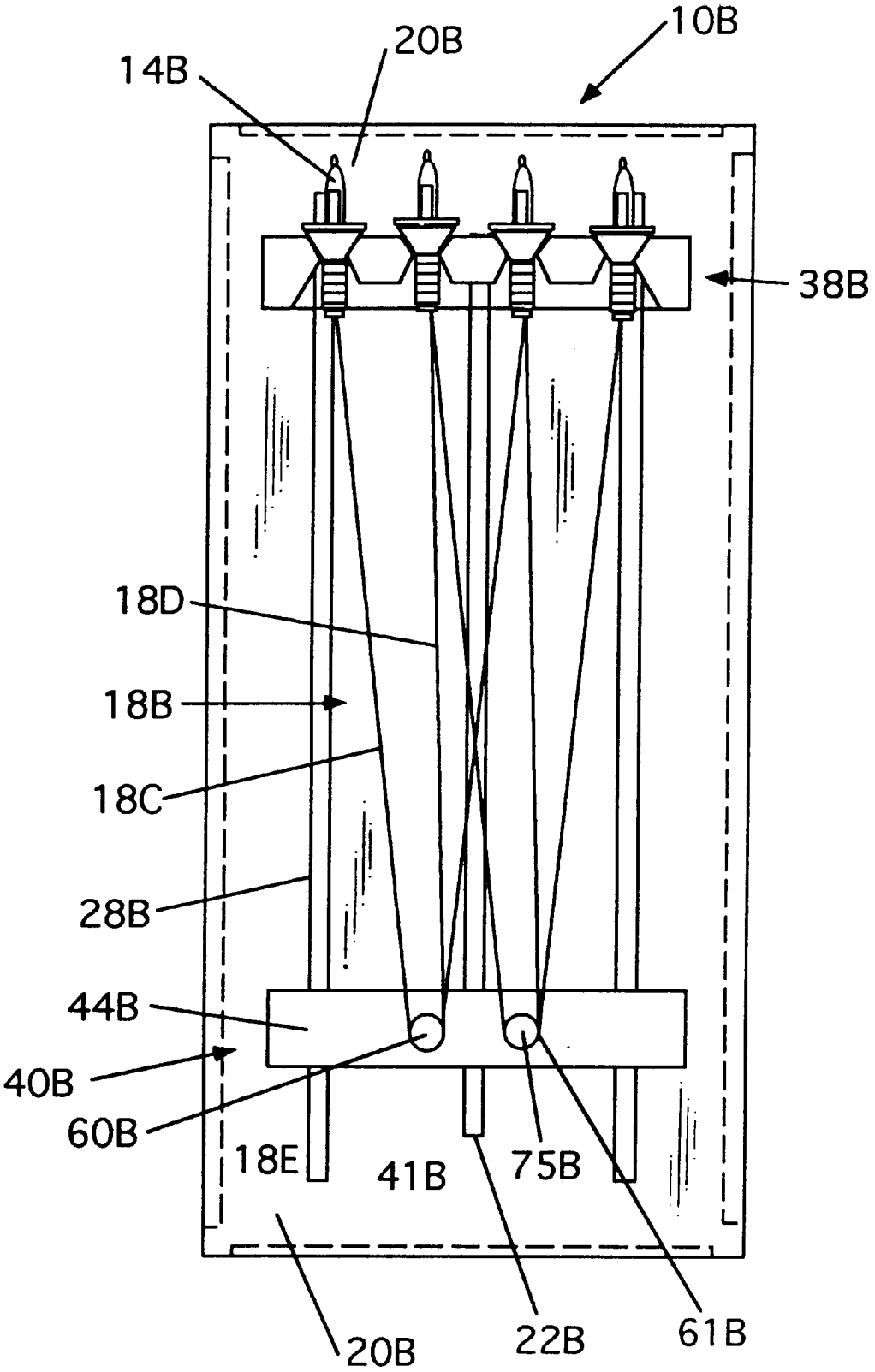
FIG. 8 is a top plan view of another slightly modified embodiment.

Referring now to FIG. 8, yet another slightly modified storage apparatus, generally designated 10B, is illustrated. Although the rack 38B is identical to the rack 38, rather than having identical racks 38 and 40, however, the light string mounting rack 40 is replaced by a rack 40B having pair of upstanding posts 60B and 61B which are integrally mounted on a platform 44B that is slidably detachably mounted on the base 20B.

In this embodiment, the conductors 18B include adjacent portions 18C and 18D spanning adjacent light bulbs 14B. The junctions 18E between the adjacent portions 18C and 18D pass around the outer surface 41'B of the posts or dowel rods 60B and 61B. Similarly, the bulbs 14B are disposed on the outer surface or outer side 41B of the tray 38B.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A holiday light storage device for storing a holiday light string having a plurality of light bulb mounts for mounting plurality of light bulbs and electrical conductors electrically coupling said mounts and bulbs in circuit, said device comprising:

an elongate base;

first and second longitudinally spaced apart, upstanding light string mounting means on which adjacent successive portions of a holiday light string are alternately mounted; and mount means mounting said first and second upstanding light string mounting means on said base in longitudinally spaced apart relation;

at least said first mounting means including a plurality of laterally spaced, upwardly opening, open ended slots for receiving said lights bulb mounts in vertically stacked relation.

2. The device set forth in claim 1 wherein said mount means includes including means adjustably mounting said first and second mounting means on said base for relative movement to any selected one of a plurality of different, longitudinally spaced apart positions.

3. The device set forth in claim 1 wherein said mount means includes means for detachably securing said one mounting means to said base;

one of said base and at least said first mounting means including a slide and the other of said base and said first mounting means including a complemental guide which guides said first light string mounting means for relative movement on said base when said first mounting means is not secured to said base.

4. The device set forth in claim 3 wherein said guides comprise a pair of laterally spaced apart elongate slots in one of said first mounting means and said base;

said guide comprises a pair of laterally spaced apart, elongate tracks, slidably in the other of said first mounting means and said base, received by said slots.

5. The device set forth in claim 4 wherein said mount means for detachably securing said one mounting means to said base is disposed between said tracks and said slots.

6. The device set forth in claim 5 wherein said base includes upper and lower surfaces and said first and second mounting means includes upper and lower ends;

said mount means for detachably securing said one mounting means includes an elongate passage extending through said base between said upper and lower surfaces and fastener means received by said passage and extending upwardly from said upper surface of said base and detachably secured to said lower end of said first mounting means.

7. The device set forth in claim 1 wherein at least said first mounting means includes a plurality of upstanding, laterally spaced apart posts defining said slots therebetween.

8. The device set forth in claim 7 wherein each of said posts comprises first and second longitudinally disposed, laterally converging walls;

said first and second converging walls of each post being disposed in confronting relation with, but spaced from, the first and second converging walls of an adjacent post.

9. The device set forth in claim 8 wherein at least one of said posts includes first and second laterally opposite sides, and first and second converging walls on each of said first and second laterally opposite sides.

10. The device set forth in claim 9 including hollow cover means for receiving said upstanding mounting means and being detachably secured to said base.

11. The device set forth in claim 1 wherein each of said light string mounting means includes a plurality of laterally spaced apart upstanding posts defining a plurality of upwardly opening, laterally spaced apart slots.

12. A light string storage device for storing a string of lights having a plurality of light bulb mounts electrically coupled in circuit with electrical conductors, said storage device comprising:

an elongate base;

a pair of light bulb mount receiving and stacking trays adjustably mounted on said base for relative longitudinal movement to any selected one of a plurality of different longitudinally spaced apart positions; and means for detachably securing said trays to said base in any selected one of said plurality of different longitudinally spaced apart positions;

each of said trays including a plurality of laterally spaced apart posts defining upwardly opening, open ended slots for receiving alternate ones of said light bulb mounts to form a vertical stack.

13. The device set forth in claim 12 wherein each of said trays includes a plurality of said slots disposed in laterally spaced apart relation.

14. The device set forth in claim 13 wherein said posts each include longitudinally disposed laterally converging walls which define one side of at least one of said slots.

15. The light storage device set forth in claim 11 wherein said base includes guide means for guiding movement of said light trays thereon, and said light trays each include slide means slidably received by said guide means.

16. The light storage device set forth in claim 15 wherein said guide means comprises a pair of laterally spaced apart, elongate slots and said guides comprises a pair of laterally spaced apart, elongate projections slidably received by said slots.

17. Apparatus for storing a string of holiday lights having a plurality of spaced apart light bulbs electrically coupled in circuit relation with electrically conductive line means, said apparatus comprising:

a base;

first and second spaced apart, elongate, string receiving and stacking members, each having one end mounted on said base, for alternately receiving successive adjacent portions of said string;

said string receiving and stacking members each including inner and outer elongate sides, said inner sides being disposed in spaced apart, confronting relation with each other;

at least said first string receiving and stacking member including an opposite end, opposite said one end, having a plurality of open ended slots therein for slidingly receiving alternate successive adjacent portions of said string with said light bulbs on said alternate successive portions being disposed on said outer side of said first string receiving and stacking member and said electrically conductive line means extending between said inner sides of said first and second string receiving and stacking members.

18. The apparatus set forth in claim 17 including means detachably mounting said one end of at least one of said string receiving and stacking members on said base for selected movement to any selected one of a plurality of different positions relative to the other of said string receiving and stacking members.

19. The apparatus set forth in claim 18 wherein said first string receiving and stacking member includes a second laterally extending base mounted on said first mentioned base and including a plurality of laterally spaced apart, upstanding posts mounted on said base in laterally spaced apart relation to define said slots.

20. Apparatus for storing string lighting having a plurality of light fixtures and electrical conductor means coupling said light fixtures in circuit, said apparatus comprising:

a base;

a pair of elongate stacking members, each having
a free end,
a second mounting end, and
inner and outer sides extending between said ends;

said one end of at least one of said stacking members including a plurality of open-ended, elongate slots extending between said inner and outer sides therein;

means mounting said second mounting ends of said elongate stacking members on said base with said inner sides of said pair of elongate stacking members being disposed in confronting, spaced apart relation for serially mounting said string lighting in a zig-zag fashion with successive portions of said string lighting being mounted on said outer sides of said stacking members and portions of said string lighting between said successive portions being slidingly received in said slots and extending between said inner sides of said stacking members.

21. Apparatus for stowing and stacking string lighting comprising a base; and means on said base for stacking said string lighting in a zig-zag path of travel to stack successive adjacent portions of said string lighting in stacked relation comprising a pair of elongate stacking members each including a free end, a mounting end, and inner and outer sides extending between said ends; and means on said stacking members for mounting said successive adjacent portions of said string between said inner surfaces and the junctions of said successive adjacent portions outwardly of said outer surfaces including a plurality of open-ended elongate slots in at least one of said stacking members for slidably receiving said successive adjacent portions.

22. A method for stowing and stacking a string of lights having a plurality of light bulbs and electrical conductor means coupling said bulbs in circuit, said method comprising:

providing first and second elongate stacking members each having first and second ends and inner and outer sides between said ends;

providing a plurality of open-ended elongate slots in said first end of at least said first stacking member;

mounting said second ends of said first and second stacking members on a base with said inner sides thereof disposed in confronting, spaced apart relation;

sequentially mounting successive portions of said string of lights in a zig-zag path alternately on said first and second spaced apart stacking members;

said sequentially mounting step being accomplished by stringing successive portions of said conductor means to-and-fro between said inner sides and disposing the junctions of said successive portions on said outer sides of said first and second stacking members.

23. The method set forth in claim 22 wherein said sequential mounting step is accomplished on said first stacking member by disposing alternate ones of said successive portions of said string in said slots with said light bulbs disposed on said outer side of at least said first stacking member and then longitudinally moving said light bulbs toward said second end into stacking relation with other similarly disposed light bulbs.

24. A method of storing and stacking a string of lights having a plurality of light bulbs coupled in circuit with electrical conductor means said method comprising:

providing first and second elongate stacking members each having one free end provided with a plurality of open-ended, elongate slots, a second mounting end, and inner and outer sides;

mounting said second mounting ends on a base with said inner sides disposed in confronting, spaced apart relation; and sequentially mounting successive adjacent light bulbs on said string of lights in a zig-zag path alternately on said outer sides of said first and second stacking members with the portions of said electrical conductor means between said successive adjacent light bulbs passing from said light bulbs extending between said inner sides of said stacking members.

25. The method set forth in claim 24 wherein said sequentially mounting step includes the step of sliding said light bulbs on said outer sides from said one end toward said other end to move the portion of said electrical conductor means between adjacent light bulbs toward said other end into stacked relation.

26. A method of storing and stacking a string of lights having a plurality of light bulbs coupled in circuit with electrical conductor means said method comprising:

providing a pair of elongate stacking members each having one free end, a second mounting end, and inner and outer sides, at least one of said stacking members including a plurality of open-ended, elongate slots therein, mounting said second mounting ends on a base with said inner sides being disposed in confronting spaced apart relation; and sequentially mounting successive adjacent portions of said string of lights in a zig-zag path alternately on said outer sides of said stacking members with portions of said electrical conductor means disposed between said successive portions being disposed in said slots and extending between said inner sides of said stacking member.

27. The method set forth in claim 26 wherein the step of mounting said second mounting ends on said base includes the step of adjustably detachably mounting said stacking members on said base in any selected one of a plurality of different spaced apart positions.

* * * * *